US005585612A

United States Patent [19]

Harp, Jr.

[11] Patent Number: 5,585,612

[45] Date of Patent: Dec. 17, 1996

[54] METHOD AND APPARATUS FOR VOTING

[75] Inventor: Roland J. Harp, Jr., Winchester, Ky.

[73] Assignee: Harp Enterprises, Inc., Lexington, Ky.

[21] Appl. No.: 406,422

[22] Filed: Mar. 20, 1995

[51] Int. Cl.[6] ..... G07C 13/00

[52] U.S. Cl. ..... 235/51; 235/386

[58] Field of Search ..... 235/51, 50 R, 235/50 A, 50 B, 54 F, 57

[56] References Cited

U.S. PATENT DOCUMENTS

| | | | |
|---|---|---|---|
| 4,377,870 | 3/1983 | Anderson et al. | 235/386 X |
| 5,189,288 | 2/1993 | Anno et al. | 235/386 |
| 5,377,099 | 12/1994 | Miyagawa | 235/386 X |

OTHER PUBLICATIONS

AIS, American Information Systems, Inc. Product Brochure; Date Unknown.

Shouptronic Electronic Voting Machine; Harp Enterprises, Inc; Product Brochure; Revised Aug. 1993.

*Primary Examiner*—Patrick J. Stanzione

*Attorney, Agent, or Firm*—King and Schickli

[57] ABSTRACT

A voting machine is provided allowing an illiterate, sight impaired or blind individual to cast a vote in privacy and without assistance from another party. The voting machine includes a ballot box having a plurality of voting mechanisms for allowing the individual to cast a vote. One voting mechanism is provided for each election candidate/each side of an election issue. The voting machine also includes an audio player that plays an audio presentation that guides the individual through the voting process by identifying each voting mechanism. A tactile and visual map may also be provided. The map cooperates with the audio presentation to orient the individual for voting. A method is also disclosed.

20 Claims, 3 Drawing Sheets

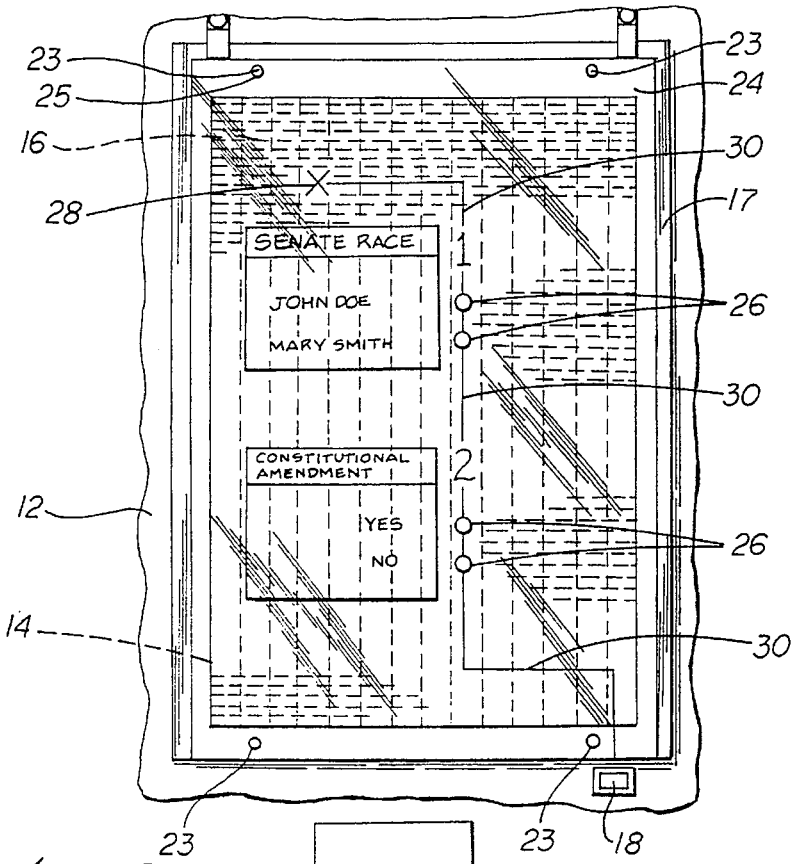
Fig. 2
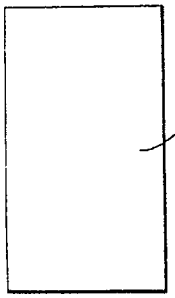
Fig. 3
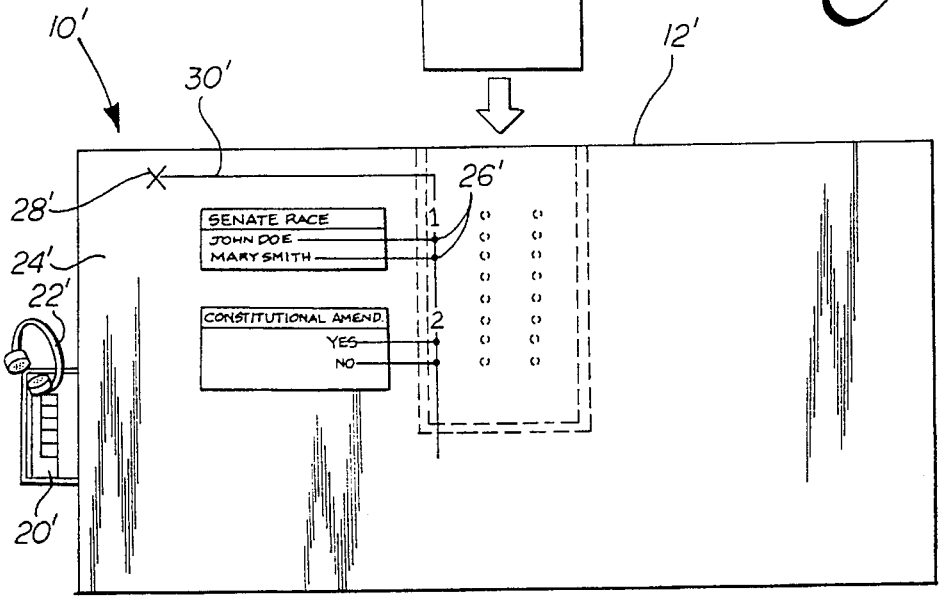

METHOD AND APPARATUS FOR VOTING

TECHNICAL FIELD

The present invention relates generally to the voting field and, more particularly, to a voting machine and method for allowing illiterate, sight impaired or blind individuals to cast a vote in privacy without assistance from another party.

BACKGROUND OF THE INVENTION

In democratic nations, voting is a method by which groups of people choose their leaders and decide public issues. In the United States, voting is considered one of the most important rights of a citizen with that right being guaranteed by the $15^{th}$, $19^{th}$, $23^{rd}$ and $26^{th}$ Amendments to the Constitution.

In the 1700's, most American Colonies conducted oral elections. The states later switched to written ballots, requiring the voters to sign their ballots. Some citizens, however, feared that others might react negatively if they voted as they wished. In order to address these concerns states began using secret ballots so that each voter could choose or vote freely with anonymity.

Today, voting machines are commonly employed to provide secrecy and simplify vote counting. Various types of voting machines are employed including, but not limited to, mechanical lever, electronic and optical scanners for reading paper ballots.

All types of state-of-the-art voting machines have one major shortcoming. None are equipped to allow an illiterate, sight impaired or blind individual the luxury and benefit enjoyed by others: the ability to vote in private. This places this relatively large group of individuals at an unfair disadvantage. Since these individuals must receive assistance to vote on state-of-the-art voting machines, they lose their anonymity in the voting process and are subjected to subtle peer pressure that may influence their vote. Further, the assisting party or official may intentionally influence or covertly lead the individual to vote counter to his/her wishes. Such possible voter fraud should be eliminated from the democratic process.

SUMMARY OF THE INVENTION

It is a primary object of the present invention is to provide a voting machine and an associated method for allowing an illiterate, sight impaired or blind individual to cast a vote in privacy without assistance from another party.

An additional object of the present invention is to provide a voting machine that provides voting independence for the illiterate, sight impaired or blind individuals in a relatively simple and straight-forward method.

Still another object of the present invention is to provide an apparatus that may be utilized with existing voting machines in the field to convert those machines for independent, substantially unassisted use by illiterate, sight impaired and blind individuals seeking to exercise their voting rights.

Still another object of the present invention is to provide a method of voting relying upon an audio presentation alone or an audio presentation in combination of a tactile and visual map whereby an illiterate, sight impaired or blind individual may identify each voting mechanism for each election candidate/each side of an election issue and independently and confidentially exercise his or her voting right.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved voting machine is provided that for the first time, allows an illiterate, sight impaired or blind individual to cast a vote substantially without assistance from another party. Thus, the individual may cast a vote in privacy and effectively enjoy voting independence for the first time.

The voting machine includes a ballet box having a plurality of voting means for allowing the individual to cast a vote. One voting means is provided for each election candidate and/or side of an election issue. The voting machine also includes an audio presentation means for guiding an individual through the voting process. The audio presentation means serves to identify each voting means for each election candidate and/or each side of an election issue.

In accordance with a further aspect of the present invention, the voting machine may also include a map to further guide the individual through the voting process. More specifically, the map functions in cooperation with the audio presentation means. Preferably, the map is both tactile and visual and serves to identify a starting point from which the audio presentation means directs the individual. Together the map and the audio presentation function to identify each voting means so that the individual may competently select his/her candidate of choice and his/her side of each election issue.

In accordance with a more specific aspect of the present invention, the tactile map is preferably sheet material and is screen printed with, puff paint/ink. While the tactile map may be printed with braille, other recognized symbols such as "X", "1", "2" etc may be utilized. In fact, these other symbols may be preferred as braille is only understood by a vast minority of sight impaired and blind individuals.

The audio presentation means may comprise a tape player that plays privately through headphones to the individual. It should be appreciated, however, that where electronic voting machines are employed, the machines may be equipped with a voice simulator and a chip to provide the appropriate presentation to instruct the individual through the voting process.

Further, the apparatus may also include a means for signalling when a vote is cast. Preferably, such a signalling means is an audio signal through the headphones which informs the voter that the selection has been made and recorded by the voting machine.

As should further be appreciated, the present voting machine may comprise an electronic voting machine or a paper ballot voting machine. More specifically, an electronic voting machine is equipped with a field of electronic switches. The tactile map overlies this field of electronic switches and cooperates with the audio presentation to guide the individual through the voting process thereby allowing the desired selections to be made when casting his/her vote.

Alternatively, in a paper ballot voting machine the voting means may be a field of punch guides for guiding a punch through a punch ballot. Still further, voting means may be a field of marker guides for guiding a marker to a proper position on a paper ballot to record a vote. In any such case, the map and audio presentation function as described above to identify each of the guides and allow the individual to cast his/her vote for the desired candidate and/or side of an issue without assistance from any other party.

In accordance with yet another aspect of the present invention a method is provided for allowing an illiterate, sight impaired or blind individual to cast a vote. The method includes the steps of preparing an audio presentation for guiding the individual through the voting process and equipping the voting machine to play the audio presentation upon demand. The method further includes the step of preparing a map to further guide the individual through the voting process in cooperation with the audio presentation. In this way it is possible for each voting means of the voting machine to be identified for each election candidate and/or each side of an election issue. As further described above, the method may also include the step of overlaying the map on the voting machine so that the senses of touch and sight may be used to follow the audio presentation.

Advantageously, the present invention not only provides true independence for the illiterate, sight impaired and blind individual when casting a vote, but it also reduces the risk of vote tampering. Specifically, it should be appreciated that when an illiterate, sight impaired or blind individual is assisted during the voting process, the individual can not readily discern if the assisting party is actually voting for the individual's selected candidate or side of an issue. Advantageously, the present method fully eliminates this problem of vote fraud.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing:

FIG. 2 is a detailed view of the map, overlayed in operative position on the voting machine shown in FIG. 1;

FIG. 3 is a top plan view of a second embodiment of the present invention showing a paper ballot voting machine specifically equipped with an audio presentation means and map overlay (partially cutaway) adapted to assist the illiterate, sight impaired or blind individual during the voting process whether that ballot is punched or marked.

Reference will now be made in detail to the present preferred embodiment of the invention, an example of which is illustrated in the accompanying drawing.

DETAILED DESCRIPTION OF THE INVENTION

Figure 1:
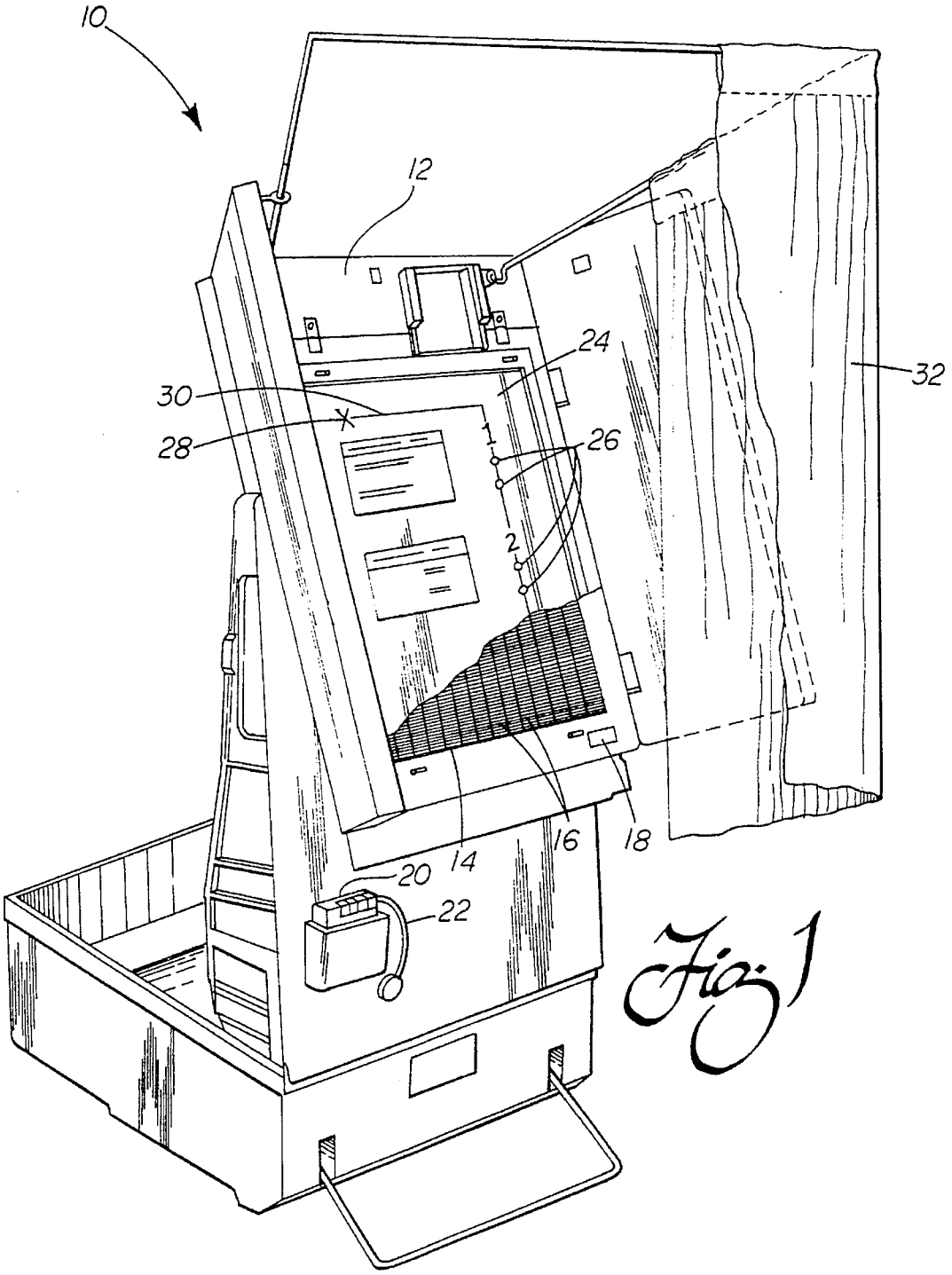
FIG. 1 is a perspective view of a first embodiment of the present invention showing an electronic voting machine equipped with audio presentation means and map overlay (partially cut away) to assist the illiterate, sight impaired or blind individual in voting.

Reference is now made to FIG. 1 showing a first embodiment of the present invention in the form of an electronic voting machine 10. As shown the voting machine 10 includes a ballot box 12 equipped with a plurality of voting means in a form of a field 14 of electronic switches 16 behind a flexible plastic film or screen 17. One such voting machine 10 is manufactured by Danaher Corp. and sold under the trademark SHOUPTRONIC 1242 Voting System. As electronic voting machines are well known in the art, a detailed description of its structure and operation will not be provided. It will simply suffice to say that a vote is cast for a selected candidate or side of an issue simply by pushing the appropriate switch 16 within the field 14. The vote is then locked in by depressing the vote button 18.

While an electronic voting machine 10 of the type described provides very accurate and dependable results and reliable overall operation it is simply not capable of allowing an illiterate, sight impaired or blind individual to cast a vote in privacy without assistance from another party. In order to address this shortcoming, the voting machine 10 is further equipped in accordance with the present invention with an audio presentation means, in the form of a tape player 20. The tape player 20 is equipped with a tape that is specifically prepared for the election in issue. More specifically, the tape provides full and complete identification of each election candidate and/or side of an election issue (e.g. such as a yes or no vote on a constitutional amendment). Further, the individual switches 16 in the field 14 for selecting each particular election candidate and/or each particular side of an election issue are also identified. Preferably, the tape player 20 plays through a set of headphones 22 so that the individual may listen to the audio presentation without interruption or distraction. As a further benefit, the individual may listen in privacy without alerting others that he/she is listening to the audio presentation.

As should further be appreciated best from viewing FIG. 2, a map overlay 24 is also provided. Preferably, the map overlay 24 provides tactile and visual information that may be used in cooperation with the audio presentation to aid the individual in identifying the appropriate switches 16 to select a particular election candidate and/or a particular side of an election issue. More specifically, the map overlay 24 is positioned across the field 14 of switches 16. Proper positioning and registering of the map overlay 24 relative to the field 14 of switches 16 is insured by the registration posts 23 on the voting machine that engage the cooperating mounting openings 25 formed in the map overlay 24.

Apertures 26 are provided in the map overlay 24 to allow access to the switches 16 that are programmed to accept a vote being cast for a particular candidate or side of an election issue. Preferably, the map overlay 24 includes an identifiable starting point 28 (such as the "X" shown in FIG. 2) that allows the individual to properly orientate himself/herself relative to the voting machine 10 for purposes of following the audio presentation. A guideline 30 extends from the starting point 28. This guideline 30 identifies the path to be followed during the audio presentation as the individual switches 16 are identified with a particular candidate and/or side of an issue.

Thus, in the example shown in FIG. 2, the map overlay 24 includes an "X" designating the starting point 28. A guideline 30 extends from the "X" to the number 1. Immediately beneath the number 1 are two apertures 26. The first aperture 26 allows access to the switch 16 programmed for casting a vote for candidate John Doe. The aperture immediately below this provides access to the switch 16 programmed for casting a vote for Mary Smith. The guideline 30 continues to extend from this second aperture 16 to the number 2. Immediately below the number 2 there is an aperture 16 allowing access to the switch programmed to record a yes vote on the election issue. The guideline 30 then leads from this aperture 26 to a second aperture allowing access to the switch 16 programmed to record a no vote on the election issue.

When a blind or sight impaired individual is ready to vote, an election official positions that individual before the voting machine 10 and helps that individual with the headphones 22. The election official may also position the individual's and hand over the starting point 28 of the map overlay 24. The election official then closes the privacy curtain 32 and initiates operation of the tape player 20 to begin playing the audio presentation. The individual may then vote in privacy without further assistance.

The audio presentation would provide instructions similar to the following:

Immediately to the right and adjacent to the starting point marked by the "X" you will find a guideline. Follow the guideline to the right and down to the number 1. This is the senate race. Continue to follow the guideline down until you reach a first hole or opening. If you wish to vote for John Doe in the senate race, press the switch in this opening. A tone will sound to confirm that your vote is recorded. If you do not hear the tone, press again. If you wish to vote for Mary Smith in the senate race continue to follow the guideline downward to the second opening. Press the switch outlined by this opening to vote for Mary Smith. Again, a tone will sound to confirm that the machine has recorded your vote. If you do not hear the tone, please press the switch again until a tone sounds.

Now follow the guideline down to the number 2. This is the constitutional amendment for term limits. If you are in favor of the constitutional amendment for term limits continue to follow the guideline down to the first opening. This opening outlines the switch for voting yes for the constitutional amendment. If you are not in favor of the amendment, follow the guideline down to the second opening. This opening outlines the switch for voting against the constitutional amendment. Press the switch of your choice. Again, a tone will sound to indicate that your selection has been recorded. If you do not hear a tone, please press the switch again. This concludes all elections and issues on today's ballot. Now follow the guideline down to the vote switch. To lock in and cast your vote, press this switch. A dual tone will then sound to notify the election official that your vote has been completed. If you need to hear this message again or if you have any questions, please consult with the election official.

Of course, it should be appreciated that this example is for a relatively simple ballot but it fully illustrates the applicably and use of the present invention in allowing an illiterate, sight impaired or blind individual to cast a vote in privacy without assistance from another party. Of course, it should be appreciated that a map overlay 24 and audio presentation will need to be customized for each election ballot. It should be appreciated that it will cost little to prepare the necessary number of copies of an audio tape. Similarly, a map overlay 24 may be prepared relatively inexpensively from sheet material (such as twenty point paperboard) screen printed with puff paint or puff ink. As a result, the map overlay 24 will provide a visual and tactile guide that fully cooperates with the audio tape to provide the necessary direction to allow the individual to vote in privacy and with confidence.

As best shown in FIG. 3, the same principals of the present invention may be applied to allow an illiterate, sight impaired or blind individual to vote on a paper ballot voting machine 10' whether utilizing a punch ballot through which holes are made with a punch or a marked ballot on which marks are marked with a marker.

More specifically, as shown in FIG. 3, the voting machine 10' includes a ballot box 12'. The ballot box 12' includes voting means in the form of a field 14' of punch guides 16' in the case of a punch paper ballot or marker guides 16' in the case of a marked paper ballot. In either event the guides 16' may comprise a metal cylinder defining a small aperture or opening.

The voting machine 10' also includes a tape player 20' with cooperating headphones 22' and a map overlay 24' preferably tactile and visual, that all function in the same manner as previously described with respect to the first embodiment shown in FIG. 1.

Figure 4:
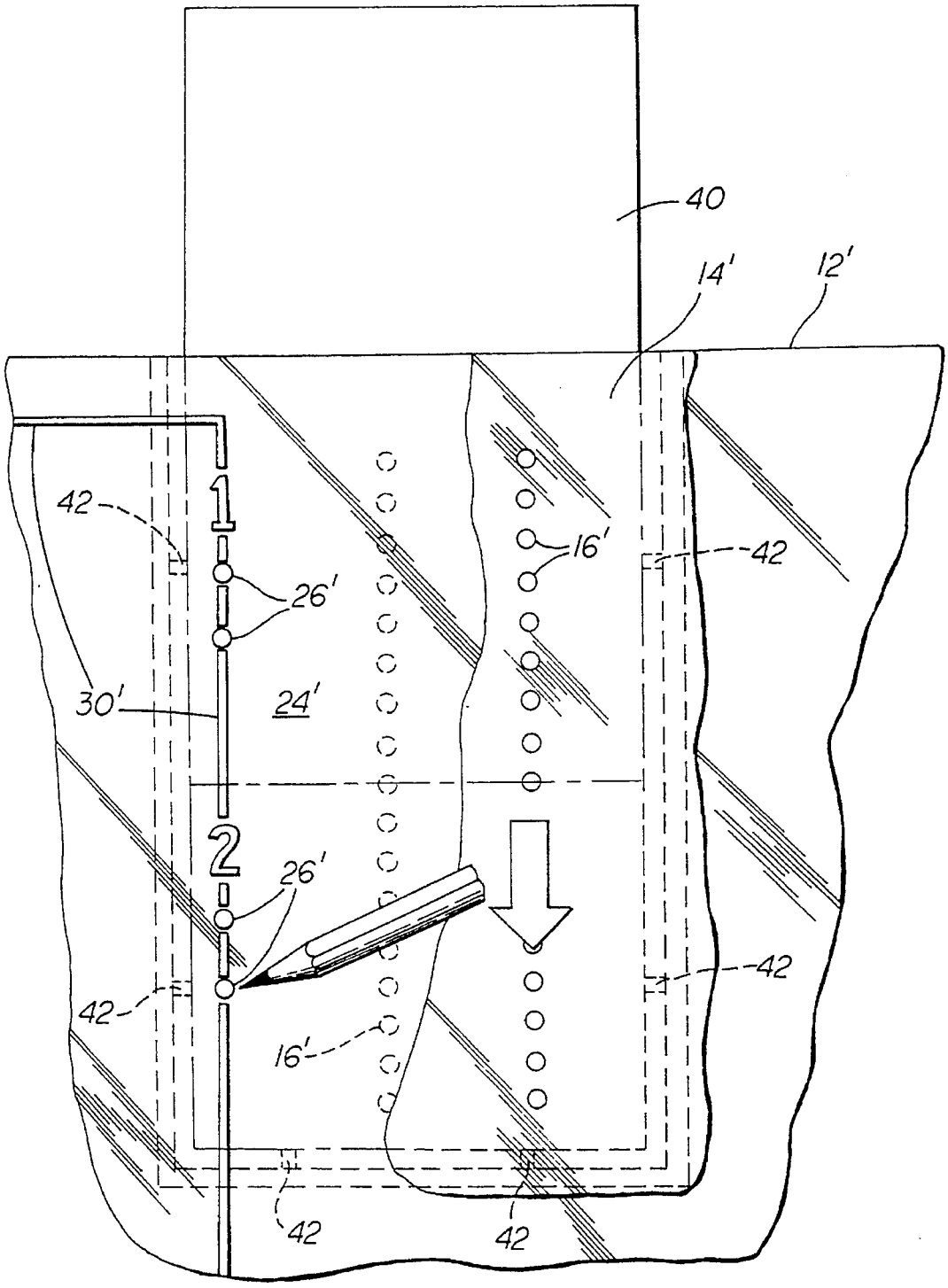
FIG. 4 is a detailed view showing the mechanism for registering the paper ballot with the tactile and audio identified punch or marker guides of the voting machine.

When an illiterate, sight impaired or blind individual wishes to vote, an election official places that individuals paper ballot 40 in the ballot box 12' of the voting machine 10'. Means such as metal guides 42 (see FIG. 4) engage the edges of the paper ballot 40 to insure proper registration of the paper ballot within the ballot box 12'. The election official also assists the individual by placing the individuals hand on the starting point 28' on the map overlay 24' (see for example, the "X" in FIG. 3). The official also helps the individual with the headphones 22' and initiates operation of the tape player 20'. This latter operation is normally done after the curtains (not shown) have been drawn to provide the individual about to vote with privacy.

The manner in which the map overlay 24'and audio presentation played through the tape player 20' and headphones 22' cooperate has been previously described. Together, they allow the individual to identify the guides 16' to allow the individual to punch or mark the paper ballot 40 in order to cast a vote for his/her candidate and/or side of an election issue. In the case of punch ballot, a punch is directed by an aperature 26' in the map overlay 24' to the selected guide 16' so as to make a hole in the paper ballot at the appropriate position on the ballot to record the individual's desired vote. In the case of a marked ballot, aperatures 26' in the map overlay 24' identify the guides 16' that function to allow the individual to mark the paper ballot 40 at the appropriate position to record the desired vote. Of course, it should be appreciated that this voting machine 10' may also include a means for signalling a vote selection. This signal may be privately provided to the voting individual through the headphones 22' or to both the headphones and to the exterior environment from the voting machine 10'. Once voting is fully completed, a dual tone may be sounded to alert the election official that the individual has completed voting.

As should be appreciated from the above description, the present method for allowing an illiterate, sight impaired or blind individual to cast a vote without assistance from another party includes the step of preparing an audio presentation for guiding the individual through the voting process. The audio presentation is custom prepared for each ballot or election and serves to identify each voting means 16, 16' (e.g. guide or switch) for each election candidate and/or each side of an election issue. The method also includes a step of equipping the voting machine 10, 10' with a means 20, 22, 20'22' to play the audio presentation upon demand. Further, the method includes a step of preparing a map overlay 24, 24' to further guide the individual through the voting process in cooperation with the audio presentation. As noted above, the map overlay 24, 24' must also be custom prepared for each ballot or election day. Preferably, the map overlay 24,24' includes tactile and visual information to aid in the voting process. The tactile information may, for example, be provided through the use of puff paint/ink. Either common symbols and/or braille may be utilized. As described, the method includes the step of overlaying the map overlay 24, 24' on the voting machine 10, 10' so that the senses of touch and/or sight may be used to follow the audio presentation. Where crowded ballots occur in a particular election, several pages of overlay maps 24, 24' may be utilized to convey all the necessary information to the voting individual. The audio tape would, of course, provide instructions for when to go to the next page.

Not only does the present invention allow the illiterate, sight impaired and blind individuals for the first time the freedom to vote in privacy, it also functions to deter vote fraud. Specifically, in the past, when the election officials have assisted such individuals and cast the vote therefore, those election officials have been in position to cast the vote for any party and not just for the party for which the illiterate, sight impaired or blind individual selected. This is because the voting individual has not been in the position to confirm that the election official has followed his/her instructions. Accordingly, the propriety of many elections has been called into question. This problem is substantially eliminated with use of the voting machines 10, 10' and method of the present invention.

In addition, the paper ballot voting machine 10' of the present invention reduces ballot printing costs, reduces ballot waste, improves the accuracy of the scanning system and maintains greater voter secrecy than state of the art paper ballot voting systems in use today. More specifically, the individual paper ballots no longer need to be printed. Any and all individuals may vote for their selected candidate and/or side of an issue by simply placing their ballot 40 in the proper position in the ballot box 12' and relying upon the information on the map overlay 24' to vote (e.g. the map overlay 24' may also convey voter information visually in written text). The guides 16' will insure that a punch or mark is made in the proper position on the ballot 40 to record the desired vote. Since no printed ballots 40 are required, ballot printing costs are completely eliminated. The guides 16' also insure that the proper punch or mark is made and, therefore, the accuracy of the scanning system that counts the votes is optimized. Additionally, since the ballots 40 are not printed, leftover ballots may be used in the next election. So waste is eliminated.

Finally, a marked/punch ballot 40 of the type used in the present invention better maintains voter secrecy. Specifically, the ballot 40 simply includes punch holes or marks but no printed information to indicate to the eye for which candidate or side of an issue an individual has voted. This better insures an unbiased vote.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A voting machine for allowing an illiterate, sight impaired or blind individual to cast a vote in privacy without assistance from another party, said voting machine comprising:

a ballot box having a plurality of voting means for allowing the individual to cast a vote, one voting means being provided for each election candidate/each side of an election issue; and audio presentation means for guiding the individual through the voting process, said audio presentation means serving to identify each voting means for each election candidate/each side of an election issue.

2. The voting machine set forth in claim 1, further including a tactile map to further guide the individual through the voting process in cooperation with the audio presentation means whereby each voting means for each election candidate/each side of an election issue may be identified.

3. The voting machine set forth in claim 2, wherein said tactile map is also a visual map, said tactile and visual map identifying a starting point from which said audio presentation means directs the individual.

4. The voting machine set forth in claim 3, wherein said tactile and visual map is sheet material screen printed with puff paint/ink.

5. The voting machine set forth in claim 2, wherein said tactile map is sheet material screen printed with puff paint/ink.

6. The voting machine set forth in claim 1, wherein said audio presentation means is a tape player that plays through headphones.

7. The voting machine set forth in claim 1, further including means for signaling when a vote is cast.

8. The voting machine set forth in claim 7, wherein said signalling means is an audio signal.

9. The voting machine set forth in claim 1, wherein said ballot box is electronic and said plurality of voting means is a field of electronic switches.

10. The voting machine set forth in claim 9, further including a tactile map that overlies said field of electronic switches to further guide the individual through the voting process in cooperation with the audio presentation means whereby each individual electronic switch for each election candidate/each side of an election issue is identified.

11. The voting machine set forth in claim 10, further including means for registering said tactile map in proper position over said field of electronic switches so as to allow the individual to vote.

12. The voting machine set forth in claim 1, wherein said plurality of voting means are a field of punch guides for guiding a punch through a punch ballot.

13. The voting machine set forth in claim 12, further including a tactile map to further guide the individual through the voting process in cooperation with the audio presentation means whereby each individual punch guide for each election candidate/each side of an election issue is identified.

14. The voting machine set forth in claim 13, further including means for registering said tactile map in proper position over said field of punch guides so as to allow the individual to vote.

15. The voting machine set forth in claim 14, further including means for registering said tactile map in proper position over said field of marker guides so as to allow the individual to vote.

16. The voting machine set forth in claim 13, further including a tactile map to further guide the individual through the voting process in cooperation with the audio presentation means whereby each individual marker guide for each election candidate/each side of an election issue is identified.

17. The voting machine set forth in claim 1, wherein said plurality of voting means are a field of marker guides for guiding a marker into contact with a marker ballot.

18. A method for allowing an illiterate, sight impaired or blind individual to cast a vote in privacy without assistance from another party on a voting machine equipped with a plurality of voting means comprising:

preparing an audio presentation for guiding the individual through the voting process, said audio presentation serving to identify each individual voting means for each election candidate/each side of an election issue; and equipping the voting machine to play the audio presentation upon demand.

19. The method set forth in claim 18, further including preparing a map to further guide the individual through the voting process in cooperation with the audio presentation whereby each voting means for each election candidate/each side of an election issue is identified.

20. The method set forth in claim 19, wherein said map is tactile and visual and further including overlaying the map on the voting machine so that the senses of touch or sight may be used to follow the audio presentation.

* * * * *